United States Patent [19]

Grappe

[11] 4,053,201

[45] Oct. 11, 1977

[54] ELECTRIC CABLE CONNECTION ADAPTED FOR HIGH EXTERNAL PRESSURES

[75] Inventor: Rene Gabriel Grappe, Paris, France

[73] Assignee: Societe Souriau et Cie, France

[21] Appl. No.: 656,128

[22] Filed: Feb. 6, 1976

[30] Foreign Application Priority Data

Feb. 14, 1975 France ..... 75.04680

[51] Int. Cl.[2] ..... H01R 13/40

[52] U.S. Cl. ..... 339/218 R

[58] Field of Search ..... 339/94, 218, 89

[56] References Cited

U.S. PATENT DOCUMENTS

| | | | |
|---|---|---|---|
| 2,177,508 | 10/1939 | Abbott | 339/94 R |
| 2,306,821 | 12/1942 | Markey | 339/89 |
| 3,184,703 | 5/1965 | Piscitello et al. | 339/60 R |
| 3,445,805 | 5/1969 | McLoad | 339/89 R |
| 3,643,208 | 2/1972 | Massa, Jr. | 339/94 R |
| 3,816,641 | 6/1974 | Iverson | 339/218 R |

*Primary Examiner*—Francis S. Husar
*Assistant Examiner*—John McQuade
*Attorney, Agent, or Firm*—Larson, Taylor and Hinds

[57] ABSTRACT

The invention relates to an union assembly for electric cables, inter alia electric cables which experience very high pressures, and adapted to be interposed between a connector element and the cable extending thereto, an insulant filing the inner chamber in which the sheathed cable conductors are connected to the corresponding elements or contact tags or posts of the connector. In said union assembly, the insulant takes the form of a resilient agent in which the conductors are embedded and which experiences via the union assembly outer wall the external pressure acting on the union.

16 Claims, 8 Drawing Figures

ELECTRIC CABLE CONNECTION ADAPTED FOR HIGH EXTERNAL PRESSURES

The invention relates to unions or connectors or the like, inter alia of the kind comprising male and female elements, which can be fitted to electric cables or which can be used as a means of connection between such cables and electrical appliances, more particularly in the case of cables which experience high pressures, inter alia hydraulic pressures, more particularly in connection with oceanographic installations.

Conventional connecting systems, inter alia in the case of submarine installations which have to withstand high pressures of the order of several tens or hundreds of bars, may be responsive for serious accidents in the event of the watertight cable sheath being torn accidentally, for seawater may then penetrate between the conductors and into the inside of the connection.

A conventional form of connection is shown for the sake of clarity in FIG. 5 of the accompanying drawings to illustrate these events.

A multicore cable 1 extends to a connection or union assembly 2, only some of which is shown, viz., the part extending around the adjacent male or female connector element 3. The assembly 2 has an inner chamber 4 into which the cable end extends; the cores or conductors 5 which extend from the cable are secured to contact tags or posts 6 of element 3.

In a system of the kind shown, chamber 4 is theoretically at the initial assembly pressure — i.e., atmospheric pressure — whereas a pressure of something like 100 bars is operative on the outside surface of cable 1, e.g. at depths of 1000 metres. If the watertight sheath of the cable is damaged at a place A so that a conductor thereof becomes accessible, the pressure difference between the place A and the inside of chamber 4 is so high that water flows into the voids between the various conductors in the cable until it fills the chamber 4, thus short-circuiting the elements of the connector 3.

It is an object of the invention to obviate this serious disadvantage.

According to a main feature of the invention, inside union assemblies of the kind described the ends of the sheathed conductors of the cables are embedded in a resilient agent filling the chamber to which such conductors extend, the resilient agent experiencing the outside pressure by way of a passage in the union assembly.

Consequently, in the event of damage to any part of the or each insulating sheath of the cable, the fluid, inter alia water, cannot travel along the sheathed conductors to the chamber, any such event being inhibited by the high pressure imparted to the fluid filling such chamber.

The resilient agent can be e.g. a known flexible compound prepared from a liquid elastomer which is first introduced into the corresponding chamber of the union assembly, then hot or cold polymerized. The whole body of the compound experiences the pressure externally, e.g. by way of at least one orifice in the union assembly, and transmits such pressure in all directions, including the between-conductors voids.

Advantageously, the conductor terminal parts concerned are maintained at appropriate spacings by appropriate spacing means before introduction of the compounds, thus ensuring that the conductors do not contact one another and that the external pressure is always transmitted over the entire outside surfaces of the conductors.

The invention also relates to other features which are preferably used simultaneously with the features just described but which can, where applicable, be used separately and which will be described in greater detail hereinafter.

According to one of the additional features, the resilient agent is given compressive prestressing treatment at assembly. Such prestressing is a means of inhibiting water or other fluid from returning to the chamber while the cable is being lifted up to the surface of the water, for it there is existing damage to a cable which is being lifted, a condition may arise in which the pressure due to the presence of a water column which has infiltrated along the sheathed conductors from the damaged area becomes greater than the outside pressure which acts on the union assembly and which decreases towards zero as lifting proceeds. In such cases water leaks would reach the inside of the union assembly. The pre-stressing just referred to inhibits any such leakages.

The prestressing can be provided e.g. through the agency of a clamping or crimping collar which is fitted around the resilient agent in the inner chamber.

The invention can in any case be readily unerstood from the remainder of the description given hereinafter and from the accompanying drawings; such remainder and such drawings are of course given mainly by way of explanation.

Figure 3:
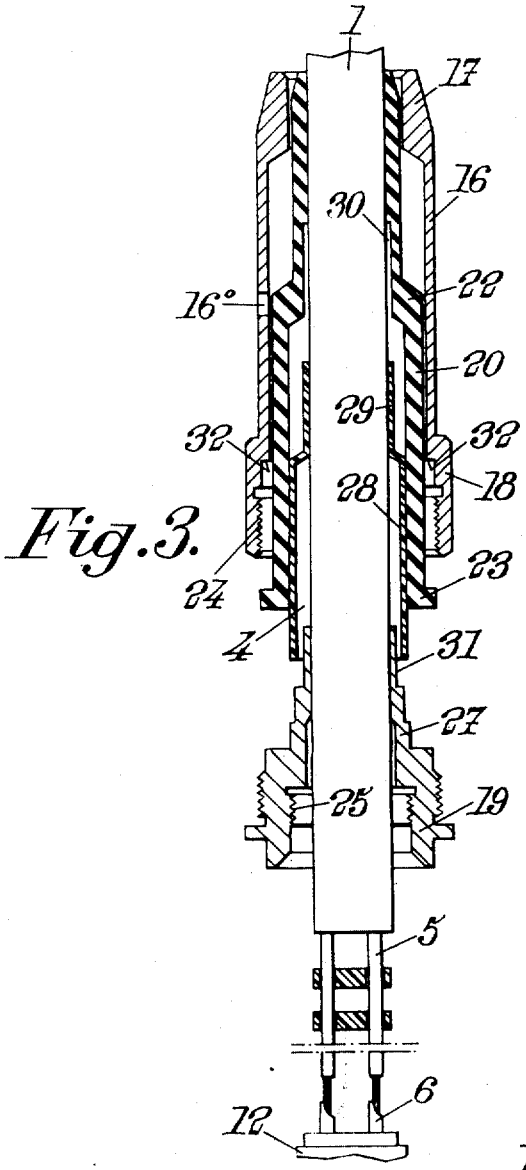
FIG. 3 is a diagrammatic view in axial section showing part of such a connection near the cable during an assembly operation, the whole according to the invention.
Figure 4:
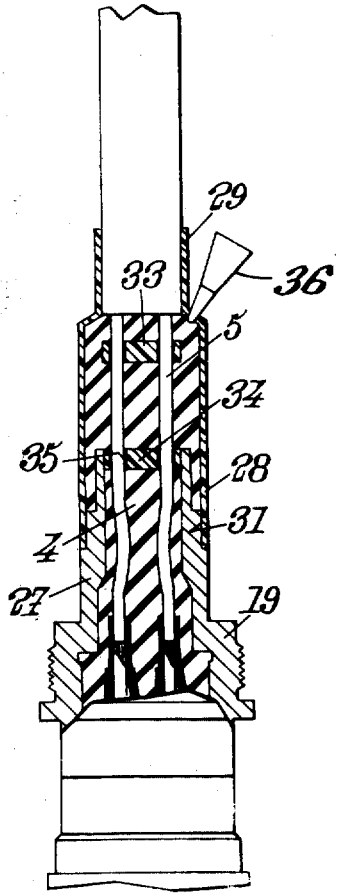
Figure 5:
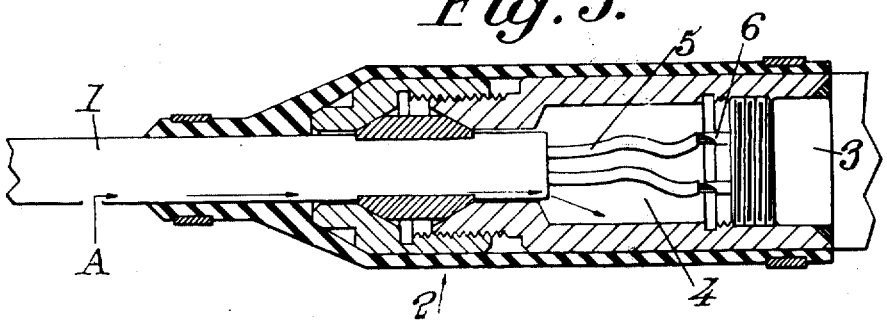
Figure 6:
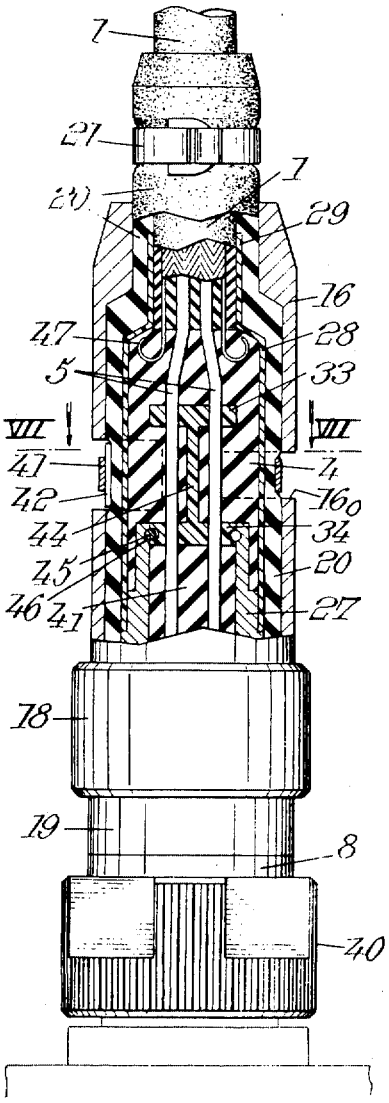
Figure 8:
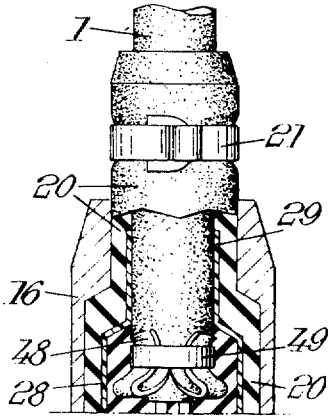
Figure 7:
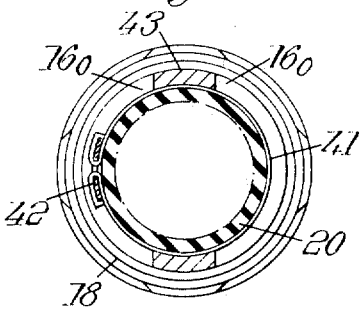

FIG. 4 similarly shows a portion of the system of FIG. 3 during the compound filling step according to the invention;

FIG. 5 is an axial section through a conventional form of connection and is given to show the differences between known forms of connection and those in accordance with the invention;

FIG. 6 and 7 are views, in axial section with parts removed and in partial cross-section on the line VII—VII of FIG. 6, respectively, of a submarine cable connector according to another form of the invention, and FIG. 8 is a view, partly in section, of an alternative form of the connector shown in FIGS. 6 and 7.

According to the invention, and more particularly according to those of its uses and those embodiments of its various parts which seem preferable, the following or a similar line of action is pursued if it is required to devise a connection facility enablig any kind of submarine appliance to be connected to a supply cable, inter alia of the kind having a number of sheathed conductors.

The complete connection facility except for the inside part adjacent the cable entry can be embodied in any known manner; according to the invention, however, the chamber 4 through which ends 5 of the sheathed conductors of the cable 1 extend for securing to the adjacent connector element experiences the outside pressure e.g. through the agency of an elastomeric agent which fills the chamber 4 and in which the conductor ends 5 are embedded.

Figure 1:
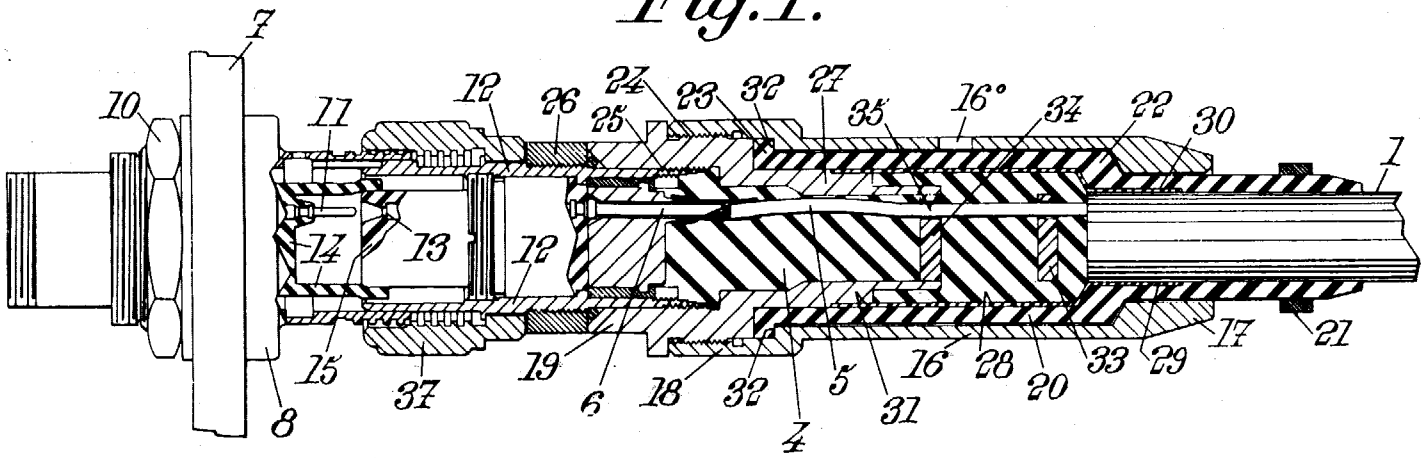
FIGS. 1 and 2 are views, in axial section in a partly connected position and in a similar partial section in the connected and locked position, of a complete system comprising an appliance casing and a cable connection therefor, inter alia for a multicore cable, the whole being in accordance with the invention.
Figure 2:
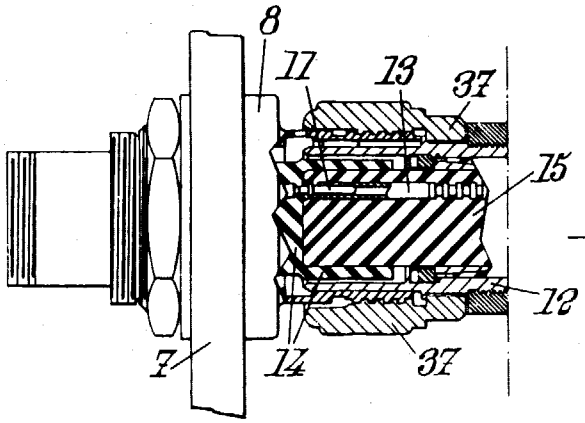

FIGS. 1 and 2 shows a connection facility comprising near the wall 7 of the particular appliance concerned male and female connector elements (the male and female functions being interchangeable), one of the connector elements taking the form of a metal base 8 which is adapted to be secured to wall 7 by any conventional means, such as a nut 10, and which has, e.g. appropriately insulates pins 11 on the side near the incoming cable 1, and the second connector element is adapted to cooperate with the first connector element and takes the form e.g. of a socket 12 having contact sleeves 13 and contact tags or posts 6, the socket 12 being adapted to be rigidly connected to the actual connection facility to be described hereinafter.

The pins 11 are insulated from one another by an insert 14 and the contact sleeves 13 are insulated from one another by an insert 15; the inserts 14, 15, which are made e.g. of neoprene, are adapted to engage in one another and to make the two connector elements completely watertight in the final connection position visible in FIG. 2.

Referring now to the actual connection facility or union assembly, which is adapted to be rigidly secured to the socket 12 at one end and to receive the conductor ends 5 of the incoming cable 1 at the other end and to provide an internal connection between the ends 5 and the socket tags 6, the main elements provided are, for instance, as shown in FIG. 1 and, more diagrammatically, in FIGS. 3 and 4 which illustrate assembly. Such main elements are:

An outer metal casing 16 of sufficient diameter to receive the other elements to be mentioned hereinafter, the casing 16 having one reduced end or neck 17 for the incoming cable 1 and a widening 18 at its other end, the casing 16 also being formed with at least one recess or the like 16' for transmitting the external pressure;

An adapter 19 adapted to be screwed into the widening 18 and thus close the inner chamber 5 receiving the conductor ends, the adapter 19 also helping to secure the socket 12, and an intermediate elastomeric sleeve-like member 20 for providing sealing tightness.

The sleeve 20, whose cable entry end engages around the incoming cable and at the termination of assembly is clamped around the cable by a collar 21, has a first intermediate shoulder 22 adapted to abut the neck 17, and a second shoulder 23 adapted to be compressed between adapter 19 and an inner edge or shoulder or the like 32 of the connection facility.

In fact, final securing between, on the one hand, the outer casing 16 and its intermediate sleeve 20 and, on the other hand, the adapter 19, both of which have previously been threaded on to the cable, occurs only upon the completion of assembly, e.g. by means of a screwthreaded connection 24, in a manner to be described hereinafter.

Also, the adapter 19 serves to secure the connection facility or union assembly to the socket 12, e.g. by means of screwthreaded connections 25, 26. Advantageously, the adapter 19 has an internal extension 27 near the central portion of the two members 16, 20. Consequently, when everything is in position in the system just described the inner chamber 4 which is adapted to receive the conductor ends 5 and to be filled with elastomer under pressure, in accordance with the main feature of the invention, arises.

Advantageously, however, to facilitate assembly and more particularly to facilitate the step of introducing the elastomer compound into the chamber 4, an additional sleeve is provided which can bound the chamber 4 in assembly independently of the outer casing 16 and of the rubber sleeve 20 previously engaged on the cable.

The additional sleeve 28 can be seen in FIGS. 1, 3 and 4, is made of an appropriate flexible substance and will hereinafter be called the "compounding sleeve". The same, whose body is devised to the inner diameter of the sleeve 20, has a narrowed end 29 which fits the corresponding narrowed end of the sleeve 20 and which therefore extends around the cable 1, being received upon the completion of the assembly in a groove 30 in sleeve 20; the other end of the compounding sleeve 28 is received in the gap between the sleeve 20 and a reduced portion 31 of the adapter extension 27.

Advantageously, means are also provided to maintain the conductors 5 in the inner chamber 4 at a desired spacing from one another; such means can take the form e.g. of guides 33, 34 embodimed as perforate plates through whose orifices the conductors 5 are threaded. This feature ensures that the compound fills all the gaps or voids between the conductors.

One guide 33 is, for instance, free whereas the other guide 34 is disposed in the adapter extension 27, the apertures 35 in the guide 34 being of slightly larger diameter than the diameter of the conductors so as not to inhibit the flow of compound during filling.

A description will now be given of working with the use of the compounding sleeve 28 in the step of filling the chamber 4 with compound.

FIG. 3 shows the start of assembly operations. The various elements hereinbefore described — i.e., the outer casing 16, the intermediate member or sleeve 20, the compounding sleeve 28 and the adapter 19 — are engaged consecutively on the end of cable 1. The conductors 5 are then brought out of cable 1 which is slightly greater than the length of chamber 4, the conductors 5 are engaged in the apertures in the two guides 33, 34 and the bare ends of the conductors are welded to the tags or posts 6 of the socket 12 (FIG. 4). The socket 12 can then be secured in the adapter 19 by means of the screwthreaded connections 25, 26.

The compounding sleeve 28 is then moved to the assembly position in the manner shown in FIG. 4. In this position the conductors 5 may have some slack in the gap separating the tags 6 from the adjacent guide 34; however, the presence of such slack is unimportant, the important thing being that the conductors should be spaced well apart from one another in the gap between the two guides 33, 34 and at the cable entry.

The compound filling operation can then begin; the compound can be an appropriate liquid elastomer which can be cold or hot polymerized. Filling can proceed in any appropriate manner, a funnel 36 being shown only by way of illustration.

Upon the completion of filling and polymerization the various items which have been threaded on the cable, inter alia the casing 16 and the sleeve 20, are moved towards the adapter 19 and the whole is secured by screwing up the connection 24.

The system is then ready for connection to the base 8, an operation which is performed using conventional means, inter alia in combination with a locking ring 37 which in conventional manner moves the male and female elements towards one another and locks the same in their final position.

The resulting connection is completely watertight, since the outer pressure is transmitted in its entirety, e.g. through orifice $16_0$, to the system embodied by the resilient sleeve 20 and the compound which completely fills the inner chamber 4.

In the event of damage to the cable, water cannot enter the chamber 4 since at the entry thereof the cables are completely embedded in the compound and the same experiences the external pressure.

The invention also covers the following features or variants which will be described in greater detail with reference to FIGS. 6 to 8.

One of such features is the combination with the system just described of provision for prestressing the elastomer in the chamber 4. Such provision can take a variety of forms. It is assumed in FIGS. 6 and 7 to take the form of a clamping collar 41 whose ends are clamped at places 42; the collar 41 is introduced towards the end of production through e.g. two recesses $16_o$ with which the casing 16 is formed and which are separated from one another by strips or tongues or the like 43 wide enough to ensure the rigidity of the complete outer casing 16.

The function of the recesses or apertures $16_o$ is therefore to enable the collar 41 to be fitted and to provide the continous communication described in the foregoing between the ambient medium and the resilient system embodied by the integers 20, 28 and the elastomer in the chamber 4.

As previously stated, the prestressing inhibits leaks from travelling along the sheathed conductors when the cable is being raised.

Practical experience has shown that, for instance, a pressure of the order of 10 bars, corresponding to a liquid column of 100 meters, is sufficient.

According to another feature of the invention, correct location, and its maintenance, of the two guides 33, 34 is achieved by preventing them from moving axially and from the rotating. This is achieved e.g. by rigidly interconnecting the two guides by one or more plastics crosspieces 44 and by providing a physical connection between the guide 33 and the adapter portion 27, so that axial and rotating movements are prevented.

The physical connection can take the form e.g. of at least one O-section clip 45 interposed between the guide 33 and the corresponding end 27 of the adapter 19, clip 45 engaging in grooves 46 in the respecitve facing walls. This feature ensures that the sheathed conductors 5 continue to remain properly located during the compound filling step.

According to another feature of the invention, means are provided to ensure a rigid connection between, on the one hand, the ends of the or each sheath of the cable 1 and, on the other hand, the inside of the chamber 4. In the case of an armoured sheath as shown in FIG. 6, for instance, the ends of the cable armor wires 4 can be straightened, whereafter they are immersed in the liquid which will subsequently form the resilient compounds. In the case of an unarmored cable as shown in FIG. 8, the ends of the or each sheath can be raised as shown by the reference 48, whereafter such ends can be clamped by a collar 49.

The compounding sleeve 28 must be big enough to cover the ends 47 or 48 in the final assembly phase before introductionn of the liquid elastomer.

Having regard to the fact that the guide 34 has to be secured to the adapter end 27, the compounding step is performed in two phases a first phase in which the volume $4_1$ which extends the chamber 4 and which is within the adapter 19 is filled, and a second phase which is similar to the phase described with reference to FIGS. 1 to 4 for filling the chamber 4 outside the part $4_1$.

The invention therefore leads in any of its embodiments to connection facilities whose operation has been described in the foregoing to an extent sufficient to make any further description unnecessary and which has many advantages over the prior art, including complete watertightness achievable without manufacturing complications.

Clearly, and as the foregoing shows, the invention is not limited to those of its uses and embodiments which have been more particularly considered but covers all the variants.

I claim:

1. In an electrical cable connector assembly which is particularly adapted for electrical cables subjected to very high external pressures, which is disposed between a connector member and the terminal end of the electrical cable, and which includes an insulator that fills an inner connector chamber wherein sheathed conductors of the cable are connected with electrical contacts of the connector member, the improvement wherein said insulator comprises a deformable, resilient material which surrounds the sheathed conductors of the electrical cable and wherein said assembly includes means providing communication of the external pressure acting on the assembly with said insulator material through the outer wall of the assembly.

2. The connector assembly as claimed in claim 1 wherein said assembly includes an outer metallic body into which said cable is received and an adapter for providing sealed connection on the connector member side so as to form said inner connector chamber wherein said sheathed conductors are connected to said electrical contacts of said connector member, said chamber containing said resilient insulator material and said metallic body including at least one orifice which provides said communication of the external pressure.

3. The connector assembly as claimed in claim 2 wherein said resilient material comprises an elastomer introduced into said chamber in liquid form subsequent to the connection of said sheathed conductors to said contacts, said elastomer being polymerized after introduction.

4. The connector assembly as claimed in claim 2 further comprising an elastomer sleeve disposed within said outer metallic body for sealingly anchoring said metallic body to said cable.

5. The connector assembly as claimed in claim 2 wherein said chamber is also formed by a flexible sleeve and wherein said chamber includes guide means for maintaining the spacing of the sheathed conductors of the electrical cable.

6. The connector assembly as claimed in claim 5 wherein said guide means comprises first and second perforated plates, one of said plates being supported by an extension of said adapter.

7. The connector assembly as claimed in claim 6 wherein said adapter includes screw threading for securing the adaptor to the connector member, said connector member including contact tags which are attached to the ends of the sheathed conductors.

8. The connector assembly as claimed in claim 1 wherein said resilient insulator comprises a prestressed material.

9. The connector assembly as claimed in claim 8 wherein said insulator comprises an inner resilient member, an intermediate compounding sleeve and an outer flexible sleeve.

10. The connector assembly as claimed in claim 9 further comprising a clamping collar disposed in a recess in the outer wall of said assembly for clamping said inner resilient member, said intermediate sleeve and said outer sleeve.

11. The connector assembly as claimed in claim 5 further comprising movement inhibiting means operatively associated with said guide means for preventing movement of said guide means.

12. The connector assembly as claimed in claim 11, wherein said guide means comprises a pair of guides, said movement inhibiting means comprising a crosspiece interconnecting said pair of guides.

13. The connector assembly as claimed in claim 5 wherein said guide means comprises a pair of guides and said assembly further comprises a retaining clip located at one end of said adapter, one of said guides disposed in vertical alignment with said one end of said adapter by means of said clip.

14. The connector assembly as claimed in claim 2 wherein a rigid connection is provided between the resilient material within said chamber and the end portions of the outer sheath of said cable which extend into said connector assembly.

15. The connector assembly as claimed in claim 2 wherein said cable comprises an armored cable and the portions of the armored wires of said armored cable received in said chamber are straight and are surrounded by said resilient material.

16. The connector assembly as claimed in claim 14 further comprising a collar securing together said said end portions of the outer sheath of said cable.

* * * * *